United States Patent [19]

Rece et al.

[11] Patent Number: 4,934,682

[45] Date of Patent: Jun. 19, 1990

[54] APPARATUS FOR FEEDING CARTONS

[75] Inventors: Wesley J. Rece, California; Joseph D. Greenwell, Florence; William A. Huening, Union, all of Ky.; Eric W. Scarpa, Cincinnati, Ohio

[73] Assignee: R. A. Jones & Co. Inc., Convington, Ky.

[21] Appl. No.: 321,998

[22] Filed: Mar. 13, 1989

[51] Int. Cl.[5] ..... B65H 5/00

[52] U.S. Cl. ..... 271/3.1; 271/113; 271/150; 271/265; 414/795.8

[58] Field of Search ..... 414/795.8, 798.9, 798.3; 271/10, 31.1, 31, 113, 150, 151, 198, 202, 110, 129, 3.1, 265

[56] References Cited

U.S. PATENT DOCUMENTS

| | | | |
|---|---|---|---|
| 3,814,000 | 6/1974 | Heisler | 271/3.1 |
| 4,429,864 | 2/1984 | Scarpa et al. . | |
| 4,511,134 | 4/1985 | Hughes | 271/31.1 |
| 4,518,301 | 5/1985 | Greenwell | 271/31.1 |
| 4,588,180 | 5/1986 | Ballestrazzi et al. | 271/31 |
| 4,717,140 | 1/1988 | Schniter | 271/31.1 |
| 4,725,052 | 2/1988 | Nakarishi | 271/150 |

*Primary Examiner*—H. Grant Skaggs

*Attorney, Agent, or Firm*—Wood, Herron & Evans

[57] ABSTRACT

A magazine for conveying cartons to a metering wheel. The magazine has a stack conveyor holding the bulk of the cartons in the magazine and a feed conveyor downstream from the stack conveyor. The two conveyors are separated by an upper inclined stop and lower ramp that keeps the cartons on the stack conveyor from applying pressure to the cartons on the feed conveyor.

8 Claims, 2 Drawing Sheets

APPARATUS FOR FEEDING CARTONS

Figure 1:
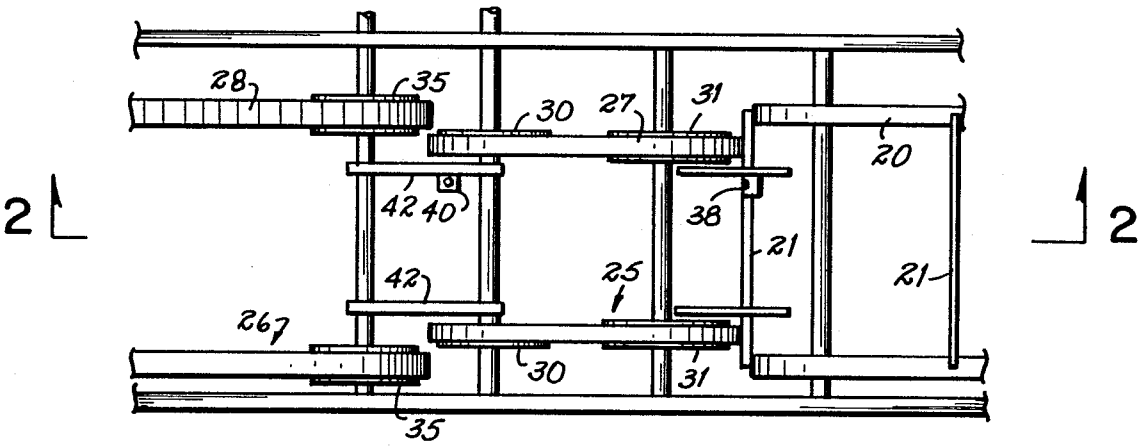

This invention relates to apparatus for feeding flat folded cartons, and more particularly to apparatus that is an improvement in the apparatus disclosed in U.S. Pat. No. 4,429,864.

In the apparatus of Pat. No. 4,429,864, a generally horizontal conveyor carries a stack of cartons that are generally vertically oriented, the cartons standing on their edges and leaning slightly forward. At the downstream end of the cartons, a rotating metering wheel slices the cartons away from the stack one at a time. Each carton, as it is sliced from the stack, is blown down onto horizontal feed chains that carry the flat folded cartons to erecting apparatus and thence to a transport conveyor where the cartons are filled and sealed.

The metering wheel that slices off the cartons will not function properly with the pressure of the whole stack leaning against the metering wheel. That pressure may be of the order of 100 pounds. To insure the proper operation of the apparatus, a pressure roller engaging the top edges of the cartons in the stack and being positioned close to the metering wheel, holds back the pressure of the stack, thereby permitting the metering wheel to function properly. The pressure roller operates satisfactorily if the cartons are of a uniform dimension, particularly thickness. If there is a change in thickness, the pressure roller may no longer function reliably. However, with an operator who is sensitive, experienced and knowledgeable, regular adjustments can be made in order to keep the cartoner operating properly.

An objective of the present invention has been to provide improved apparatus for holding back a major portion of a horizontal stack of vertically oriented cartons being conveyed to a feeder.

It is a further objective of the invention to provide apparatus for feeding flat folded cartons, the apparatus not requiring overly knowledgeable and sensitive operators to maintain a continuous flow of cartons to the feeder.

This objective of the invention is attained by providing a two conveyor magazine having a hold back mechanism between the two conveyors. More specifically, the apparatus has a feeder conveyor on which a relatively few cartons are vertically oriented and conveyed to a feeder which slices them off one at a time for further processing. Upstream of the feeder conveyor is a stack conveyor which can be many, many feet long. An upper stop and lower ramp are provided between the two conveyors to hold back the pressure of the cartons on the stack conveyor from the cartons on the feed conveyor. When the cartons on the feed conveyor are diminished, that condition, monitored by an electric eye, causes the operation of the stack conveyor to move cartons in the stack conveyor forward. As the upper flight of the stack conveyor moves forward, it causes the lower edges of the generally vertical cartons resting on it to move forward. Those lower edges slide down a ramp which is inclined at an angle of about 45°. The dropping of the cartons brings the upper edge of each carton below the upper stop so that the cartons flop forward onto the cartons of the feeder stack on the feeder conveyor.

Preferably, the electric eye is positioned so as to keep a supply one-half inch or so thick on the ramp at the trailing edge of the group on the feed conveyor. That "mini magazine" of cartons applies a slight pressure to the lower edges of the cartons on the feed conveyor and prevents those cartons from sliding rearwardly and causing the cartons to slump.

Figure 2:
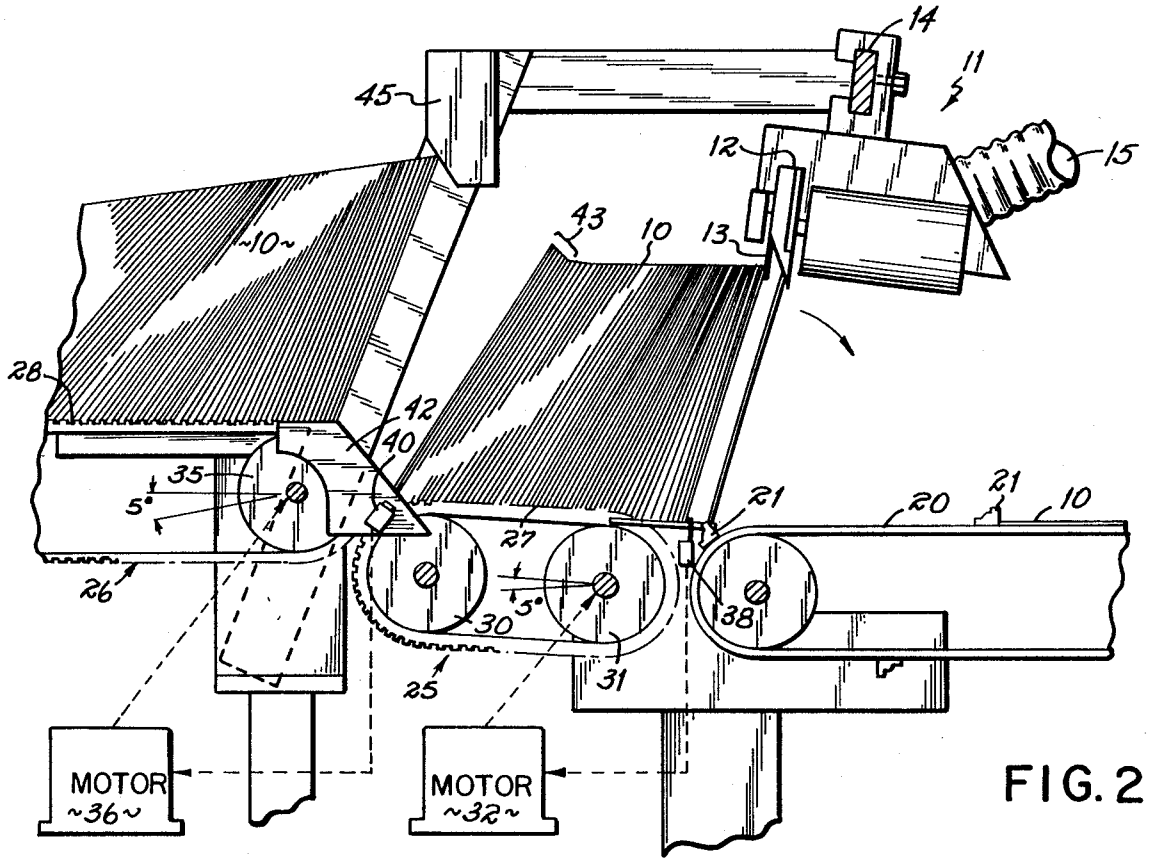

The several features of the invention will become more readily apparent from the following detailed description taken in conjunction with the accompanying drawings in which:

FIG. 1 is a diagrammatic plan view of the conveyor and ramp system, with cartons removed, showing the transverse positioning of the conveyors or ramps; and FIG. 2 is a cross-sectional view taken along lines 2—2 of FIG. 1 with the cartons in place.

Referring to the drawings, flat folded cartons 10 are to be conveyed to a feeder mechanism 11 of the type disclosed in U.S. Pat. No. 4,429,864. The apparatus is suitable for conveying cartons to other feeder mechanisms such as that disclosed in U.S. Pat. No. 4,518,301. In the '864 patent, a metering wheel 12 having a generally helical slicing blade 13 is mounted on a machine frame 14 so as to overlie the stack. Provision is made for adjusting the transverse as well as vertical positions of the metering wheel 12 to accommodate different sizes of cartons. A blower system 15 is also provided to apply a continuous flow of air downwardly against the cartons so as to apply a force of air against each carton 10 that is sliced off from the stack, thereby driving the carton in a pivotal motion about its lower edge downward. Feeder chains 20 having spaced upstanding lugs 21 continuously pass under the feeder 11 to capture the cartons thrust upon it and to convey them to carton erecting apparatus and onto the transport lugs of the cartoner.

The cartons are conveyed to the feeder by a feed conveyor 25 and a stack conveyor 26 upstream of the feed conveyor. The conveyors 25 and 26 each consist of a pair of notched chains. One notched chain and one smooth chain or a pair of smooth chains or belts can also be used for each conveyor. Conveyor 25 has an upper flight 27 and conveyor 26 has an upper flight 28, the upper flights being at an angle of about 5° to a horizontal plane. The conveyor chains 25 pass around sprockets 30 and 31, the sprockets 31 being connected to a motor as diagrammatically shown at 32. The chain of stack conveyor 26 passes around forward sprockets 35 and rearward sprockets, not shown. The forward sprocket is driven by a motor diagrammatically shown at 36.

A limit switch 38 is mounted at the downstream end of the feed conveyor 25. As the supply of cartons is diminished by the cartons having been taken away by the metering wheel 12, that absence of cartons detected by the switch 38 causes the operation of the motor 32 to drive the feed conveyor 25 the amount necessary to replenish the supply of cartons at the metering wheel.

At the trailing end of the cartons on the feed conveyor 25, an electric eye 40 is positioned to detect the depletion of cartons at the trailing end of the cartons on the feed conveyor. That electric eye is operably connected to the motor 36 to cause the operation of the motor 36 and hence the advancing of the stack conveyor 26 to replenish the supply of the cartons on the feed conveyor.

A ramp 42 is positioned between the upstream end of the feed conveyor 25 and the downstream end of the stack conveyor 26. The ramp 42 is at an angle of about 45° to horizontal. Cartons from the stack conveyor 26 slide down the ramp 42 onto the feed conveyor 25. The electric eye 40 is positioned about one-half inch up the ramp from the feed conveyor so as to maintain a small stack (mini magazine) of cartons indicated at 43 at the trailing end of the cartons on the feed conveyor. That small stack 43 keeps pressure on the lower edges of the cartons 10 on the feed conveyor to prevent them from sliding rearwardly causing the stack on the feed conveyor to slump.

Above the ramp 42 is an inclined stop 45 that is at an angle of about 60° to horizontal. The upper edges of the cartons in the stack on the stack conveyor 26 lean against the inclined stop 45 and are prevented from falling forward onto the cartons on the feed conveyor. Thus, the entire pressure of the stack, which can be of the order of 100 pounds, is completely blocked from application of any force to the cartons on the feed conveyor.

When the stack conveyor is operated causing the lower edges of the cartons to slide onto the ramp 42, the upper edges of those cartons will slide down the inclined stop 45 and have a substantial forward component of motion. That forward component of motion will provide assurance that the cartons sliding down the ramp 42 do not lean rearwardly. Rather, as the upper edges of the cartons clear the ramp 42, the cartons fall forwardly, thus forming the small stack 43 on the ramp 42. In this way, the pressure of the upstream cartons is kept off the carton immediately adjacent the metering wheel 12, thereby permitting the metering wheel 12 to operate continuously and reliably with minimal operator attention. Ideally, the operator is simply required to be sure that cartons are regularly added to the stack of cartons on the stack conveyor as the supply is depleted.

In operation, the metering wheel slices cartons off the stack on the feed conveyor. Those cartons are blown down onto the feed chains 20 where they are picked up by the lugs 21 and moved in a forward direction. The switch 38 monitors the depletion of the cartons at the downstream end of the stack on the feed conveyor. When the supply needs replenishing, the switch 38 causes the motor 32 to operate to advance the stack on the feed conveyor to the point that the limit switch is satisfied.

The continuous advancement of the stack on the feed conveyor diminishes the number of cartons on the ramp 42 as detected by the electric eye 40. When the supply needs replenishment, the electric eye signals the motor 46 on the stack conveyor causing the stack conveyor to bring up more cartons. As each carton is conveyed past the upper edge of the ramp 42, its lower edge slides down the ramp and its upper edge slides off the inclined stop 45, thereby dropping each carton forwardly onto the small group of cartons 43 on the ramp 42. In this way, cartons are continuously supplied at a substantially uniform and low pressure to the metering wheel 12. Cartons on the stack conveyor are held back by the inclined stop 45 and are permitted to pass the inclined stop 45 by having their lower edges advanced to bring them onto the ramp 42.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof.

We claim:

1. Apparatus for feeding cartons comprising, a frame, a feeder mounted on said frame, an endless feeder conveyor mounted on said frame and having an upper run whose discharge end lies adjacent said feeder, an endless stack conveyor mounted on said frame upstream from said feeder conveyor, said stack conveyor having an upper run that is elevated from said feeder conveyor upper run, said conveyors carrying flat folded cartons in a generally vertical attitude and leaning slightly forward, a downwardly-inclined ramp between said stack conveyor and said feeder conveyor, said ramp being engageable by the lower edges of said cartons to permit the cartons to slide from said stack conveyor to said feeder conveyor, said ramp creating a gap between cartons on said stack and feeder conveyors, said stack conveyor upper run having a discharge end adjacent said feeder conveyor, a stop mounted above said stack conveyor discharge end to block forward movement of the cartons on said stack conveyor.

2. Apparatus as in claim 1, said stop comprising, a downwardly-inclined, rearwardly-facing surface spaced above the discharge end of said stack conveyor upper run, said inclined surface engaging the upper edge of the leading carton on said stack conveyor to prevent said leading carton and the rest of said stack from advancing onto said feeder conveyor.

3. Apparatus as in claim 1 further comprising, means for driving said stack conveyor, a detector adjacent said ramp for monitoring the position of the trailing carton of the cartons on said feed conveyor, said detector connected to said driving means to operate said stack conveyor when said trailing carton has moved past said detector, said detector being positioned to keep a supply of cartons on said ramp, thereby maintaining the bottom edges of said cartons from sliding rearwardly.

4. Apparatus as in claim 1 further comprising, means for driving said stack conveyor to replenish said feed conveyor when said stack on said feeder conveyor is diminished by a preselected amount of cartons.

5. Apparatus for feeding cartons comprising, a frame, a rotary feeder mounted on said frame, an endless feeder conveyor mounted on said frame and having an upper run whose discharge end underlies said rotary feeder, means for driving said feeder conveyor, an endless stack conveyor mounted on said frame upstream from said feeder conveyor, said stack conveyor having an upper run that is elevated from said feeder conveyor upper run, means for driving said stack conveyor, said conveyors carrying flat folded cartons in a generally vertical attitude and leaning slightly forward, said stack conveyor upper run having a discharge end adjacent said feeder conveyor, an inclined rearwardly-facing stop mounted above said stack conveyor discharge end to block forward movement of the cartons on said stack conveyor, a forwardly-facing ramp below said inclined stop to guide the lower edges of cartons onto said feeder conveyor.

6. Apparatus as in claim 5 in which said ramp is at about 45° to horizontal and said inclined stop is at an angle greater than 45° to horizontal, whereby said stop imparts a controlled slide to the upper edges of cartons as the lower edges slide down said ramp.

7. Apparatus for feeding cartons comprising, a frame, a feeder mounted on said frame, an endless feeder conveyor mounted on said frame and having an upper run whose discharge end lies adjacent said feeder, an endless stack conveyor mounted on said frame upstream from said feeder conveyor, said stack conveyor having an upper run that is elevated from said feeder conveyor upper run, said conveyors carrying flat folded cartons in a generally vertical attitude and leaning slightly forward, a downwardly-inclined ramp between said stack conveyor and said feeder conveyor, said ramp being engageable by the lower edges of said cartons to permit the cartons to slide from stack conveyor to said feeder conveyor, said ramp creating a gap between cartons on said stack and feeder conveyors, said stack conveyor upper run having a discharge end adjacent said feeder conveyor, a stop mounted above said stack conveyor discharge end to block forward movement of the cartons on said stack conveyor, and means for maintaining a supply of cartons on said ramp to apply pressure to the lower edges of downstream cartons to keep them from sliding rearwardly.

8. Apparatus for feeding cartons comprising, a frame, a rotary feeder mounted on said frame, an endless feeder conveyor mounted on said frame and having an upper run whose discharge end underlies said rotary feeder, means for driving said feeder conveyor, an endless stack conveyor mounted on said frame upstream from said feeder conveyor, said stack conveyor having an upper run that is elevated from said feeder conveyor upper run, means for driving said stack conveyor, said conveyors carrying flat folded cartons in a generally vertical attitude and leaning slightly forward, said stack conveyor upper run having a discharge end adjacent said feeder conveyor, an inclined rearwardly-facing stop mounted above said stack conveyor discharge end to block forward movement of the cartons on said stack conveyor, a forwardly-facing ramp below said inclined stop to guide the lower edges of cartons on said feeder conveyor, and means for maintaining a supply of cartons on said ramp to apply pressure to the lower edges of downstream cartons to keep them from sliding rearwardly.

* * * * *